US009373433B2

(12) United States Patent
Johnson et al.

(10) Patent No.: US 9,373,433 B2
(45) Date of Patent: Jun. 21, 2016

(54) NANOCOMPOSITE PERMANENT MAGNETS AND METHODS OF MAKING THE SAME

(75) Inventors: Francis Johnson, Clifton Park, NY (US); Robert Edgar Colborn, Niskayuna, NY (US); Judson Sloan Marte, Wynantskill, NY (US); Peter John Bonitatibus, Jr., Saratoga Springs, NY (US); Binil Itty Ipe Kandapallil, Mechanicville, NY (US); Mohammed Haouaoui, Niskayuna, NY (US); Christina Chen, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 1028 days.

(21) Appl. No.: 13/538,229

(22) Filed: Jun. 29, 2012

(65) Prior Publication Data

US 2014/0002220 A1 Jan. 2, 2014

(51) Int. Cl.

| | |
|---|---|
| ***B22F 3/24*** | (2006.01) |
| ***B22F 3/02*** | (2006.01) |
| ***H01F 7/02*** | (2006.01) |
| ***H01F 41/02*** | (2006.01) |
| ***H01F 1/057*** | (2006.01) |
| ***C22C 1/02*** | (2006.01) |
| *H01F 1/06* | (2006.01) |
| *H01F 1/10* | (2006.01) |

(52) U.S. Cl.

CPC ..... *H01F 1/0579* (2013.01); *C22C 1/02* (2013.01); *H01F 41/0273* (2013.01); *H01F 1/0576* (2013.01); *H01F 1/068* (2013.01); *H01F 1/10* (2013.01)

(58) Field of Classification Search

CPC ..... B22F 1/0018; B22F 1/0044; B22F 2009/043; B22F 3/20

See application file for complete search history.

(56) References Cited

U.S. PATENT DOCUMENTS

| | | | | |
|---|---|---|---|---|
| 2,999,275 | A | 9/1961 | Blume, Jr. | |
| 6,183,571 | B1 * | 2/2001 | Inoue | H01F 1/0571 148/302 |
| 6,972,046 | B2 | 12/2005 | Sun et al. | |
| 2001/0015239 | A1 | 8/2001 | Kanekiyo | |
| 2002/0112785 | A1 | 8/2002 | Sekine et al. | |
| 2003/0121364 | A1 | 7/2003 | Sun | |
| 2004/0099346 | A1 | 5/2004 | Nishiuchi et al. | |
| 2006/0005898 | A1 | 1/2006 | Liu et al. | |
| 2010/0054981 | A1 | 3/2010 | Liu | |
| 2012/0003114 | A1 | 1/2012 | Baker et al. | |
| 2012/0019341 | A1 | 1/2012 | Gabay et al. | |

(Continued)

FOREIGN PATENT DOCUMENTS

EP 1014393 A1 6/2000

OTHER PUBLICATIONS

Popov, (The physics of Metals and Metallography, 2007, vol. 104, p. 238-247).*

(Continued)

*Primary Examiner* — Jie Yang
*Assistant Examiner* — Xiaowei Su
(74) *Attorney, Agent, or Firm* — Paul J. DiConza

(57) ABSTRACT

A method of making a nanocomposite permanent magnet is provided. The method comprises applying an extreme shear deformation to hard magnetic phase nanoparticles and soft magnetic phase nanoparticles to align at least a portion of the hard phase magnetic particles and to produce a nanocomposite permanent magnet.

18 Claims, 13 Drawing Sheets

(56) References Cited

U.S. PATENT DOCUMENTS

| | | | | |
|---|---|---|---|---|
| 2012/0019342 | A1 | 1/2012 | Gabay et al. | |
| 2015/0147217 | A1 * | 5/2015 | Johnson | H01F 1/0579 419/23 |

OTHER PUBLICATIONS

Zuocheng et al., "High-coercivity (NdDy)2(FeNb)14B-α-Fe Nanocrystalline Alloy", Journal of Applied Physics, vol. 81, Issue 8, Apr. 1997; 2 Pages.

Liu et al., "High Energy Products in Exchange-Coupled Nanocomposite Films", IEEE Transactions on Magnetics, vol. 35, Issue 5, Sep. 1999; 7 Pages.

Fukunaga et al., "Computer Simulation of Magnetic Properties of Anisotropic Nanocomposite Magnets", IEEE Transactions on Magnetics, vol. 36, Issue 5, pp. 3285-3287, Sep. 2000.

Sellmyer et al., "Fundamental and Magnetic-Hardening Studies of Rare-Earth and Nanocomposite Magnets", Research Papers in Physics and Astronomy, Dec. 22, 2003; 10 pages.

Hadjipanayis, "The Drive Towards Super-Strong Magnets", WavePro Conference, Jun. 8-11, 2011; 23 Pages.

Liu et al., "Aligned and Exchange-Coupled FePt-based Films", Applied Physics Letters, vol. 99, Issue 17, pp. 172504-1-172504-3, Oct. 28, 2011; 4 Pages.

International Search Report and Written Opinion issued in connection with corresponding PCT Application No. PCT/US2013/047745 dated Apr. 3, 2014.

* cited by examiner

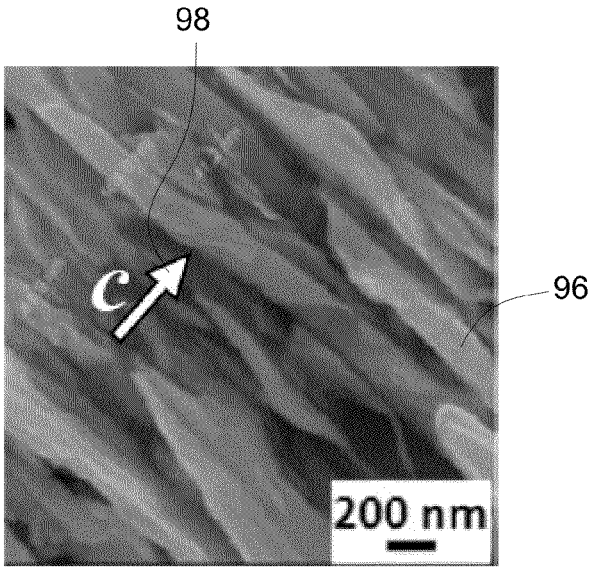
FIG. 6
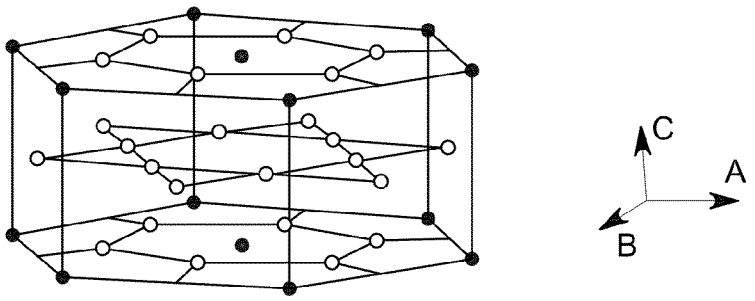

NANOCOMPOSITE PERMANENT MAGNETS AND METHODS OF MAKING THE SAME

This invention was made with Government support under grant number DE-AR0000158 awarded by the Advanced Research Projects Agency-Energy (ARPA-E). The Government has certain rights in the invention.

BACKGROUND

The invention relates to magnets, and more particularly to nanocomposite permanent magnets and methods of making the same.

Permanent magnets are used in a wide variety of fields, including electronics, industrial and electric motors. Growing global demand for high efficiency electric machines, such as electric motors and generators, has correspondingly increased the demand for high efficiency permanent magnets. For example, magnets with higher energy products facilitate making relatively compact electric machines that have relatively higher power densities.

Generally, permanent magnets are made from compounds of rare earth metals such as $Nd_2Fe_{14}B$, $SmCo_5$ and $Sm_2Co_{17}$. Usually, these compounds of the rare earth metals may contain small percentages of other rare earth metals. For example, small percentages of dysprosium and terbium may be added to the permanent magnets to enhance intrinsic coercivity of the permanent magnets. The permanent magnets with enhanced intrinsic coercivity may demonstrate enhanced performance at high temperatures. However, as will be appreciated, the rare earth metals have been identified as critical elements due to their limited supply in the face of increasing demand. A rapid rise in the cost of the rare earth metals poses challenges in making the rare earth containing magnets viable candidates for bulk use, such as industrial applications.

Therefore, it is desirable to provide economically feasible permanent magnets that contain relatively lower amounts of rare earth metals.

BRIEF DESCRIPTION

In one embodiment, a method of making a nanocomposite permanent magnet is provided. The method comprises applying an extreme shear deformation to hard magnetic phase nanoparticles and soft magnetic phase nanoparticles to align at least a portion of the hard phase magnetic particles and to produce a nanocomposite permanent magnet.

In another embodiment, a nanocomposite permanent magnet is provided. The nanocomposite permanent magnet comprises a hard magnetic phase having nanoparticles with an aspect ratio in a range from about 2:1. to about 100:1; and a soft magnetic phase in magnetic coupling with the hard magnetic phase, wherein a volume percent of the hard magnetic phase is in a range from about 10% to about 30%, and wherein a volume percent of the soft magnetic phase is in a range from about 70% to about 90%.

DRAWINGS

These and other features, aspects, and advantages of the invention will become better understood when the following detailed description is read with reference to the accompanying drawings in which like characters represent like parts throughout the drawings, wherein:

FIG. 6 is a micrograph of surfactant coated nanoparticles of a hard magnetic phase in accordance with embodiments of the present technique;

DETAILED DESCRIPTION

Figure 1:
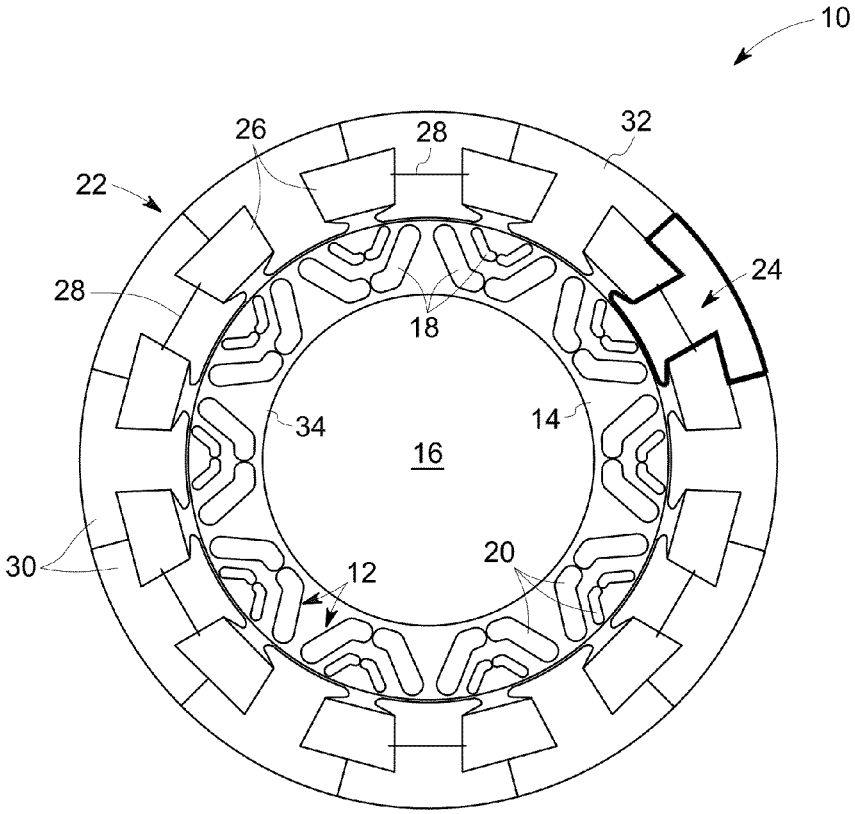
FIG. 1 is a cross-sectional view of an example motor that employs nanocomposite permanent magnets, in accordance with embodiments of the present technique.

Typically, nanocomposite permanent magnets demonstrate enhanced magnetic properties and require lower amounts of rare earth contents as compared to conventional permanent magnets that exhibit lower or similar magnetic properties. Typically, the production of nanocomposite permanent magnets includes replacing some fraction of the permanent magnet compound with another magnetic compound which may have about zero rare earth content. The magnetic performance of the nanocomposite magnets may be at least partially attributed to microstructural features of the nanocomposite permanent magnet. For example, the magnetic performance of the nanocomposite magnets may be at least partially attributed to length scales of the particles of the nanocomposite magnets. It is required that the nanocomposite permanent magnet is able to retain the characteristic microstructural features and dimensions throughout various steps of the production process. Further, it is required that the crystal structure axes of the permanent magnets be aligned to achieve higher magnetic performance of the nanocomposite permanent magnets.

Therefore, it is desirable to provide improved nanocomposite permanent magnets having enhanced magnetic performance. Further, it is desirable to provide methods for making the nanocomposite permanent magnets while retaining the characteristic microstructural features of the nanocomposite permanent magnets.

Embodiments disclosed herein generally relate to nanocomposite permanent magnets and methods of making the same. In certain embodiments, the nanocomposite permanent magnets may include at least two constituent phases, namely a hard magnetic phase and a soft magnetic phase. The hard magnetic phase may be a permanent magnetic phase. The soft magnetic phase may have relatively high magnetization and the hard magnetic phase may have relatively high coercive force. The soft and hard magnetic phases may be magnetically coupled by an exchange coupling interaction between the two phases.

In some embodiments, the hard magnetic phase may comprise one or more compounds, such as, but not limited to, samarium cobalt (e.g., $SmCo_5$, $Sm_2Co_{17}$), neodymium iron boron (e.g., $Nd_2Fe_{14}B$), samarium iron nitrogen (e.g., $Sm_2Fe_{17}N_3$), iron platinum, cobalt platinum, iron palladium, cobalt palladium, aluminum nickel cobalt, barium-hexaferrite, strontium-hexaferrite, manganese bismuth, manganese aluminum, or combinations thereof. In some embodiments, the soft magnetic phase may include compounds or alloys of iron, iron cobalt, iron silicon, iron nickel, iron boron, or combinations thereof.

In certain embodiments, the nanocomposite permanent magnets disclosed herein may be used in diverse fields, such as, but not limited to, electronics, healthcare, information and communications, industrial, and automotive. In these embodiments, the nanocomposite permanent magnets may be used for small or large scale applications. In one embodiment, the nanocomposite permanent magnets may be employed in electric machines or drives, such as, but not limited to, generators, traction motors, compressor drives, gas strings and magnetic resonance imagers. By way of example, the nanocomposite permanent magnets may be used in electric motors for automobiles, generators for wind turbines, traction motors for hybrid vehicles, such as but not limited to, cars, locomotives, and magnetic resonance imaging applications.

In certain embodiments, the hard and soft magnetic phases may comprise nanoparticles. In some embodiments, constituent phases of the nanocomposite permanent magnets may include a matrix-based structure where the nanoparticles of the hard magnetic phase may be dispersed in a matrix formed by the soft magnetic phase, or vice versa. In some other embodiments, the constituent phases of the nanocomposite permanent magnets may include a core-shell structure. In these embodiments, the nanoparticles of the hard magnetic phase may form the core and the nanoparticles of the soft magnetic phase may form the shell, or vice versa, where the shell is disposed around the core and at least partially surrounds the core.

In certain embodiments, properties of the nanoparticles of the hard and soft magnetic phases may be selected so as to enhance the magnetic properties of the nanocomposite permanent magnet formed by these nanoparticles. The magnetic properties of the nanoparticles of the hard and/or soft magnetic phases may be selected to provide a nanocomposite permanent magnet having desirable magnetic properties.

The magnetic characteristics may include, but are not limited to, a specific coercivity, magnetocrystalline anisotropy, unsaturated loops, superparamagnetic, ferromagnetic, low or high remanence ratio, single phase-like magnetization, amorphous structure, and exchange coupling.

In one embodiment, a chemical composition, morphology, a size, an orientation, a crystallographic structure, a microstructure, or combinations thereof, of the nanoparticles may be varied. In one embodiment, the morphology of the hard magnetic phase nanoparticles may include, but is not limited to, shape, size, aspect ratio, or crystalline nature (e.g., monocrystalline, polycrystalline, amorphous). Non-limiting examples of the shape of the hard magnetic phase nanoparticles may include nanoflakes, nanorods, plate-like structures, cuboids, spheres, ellipsoids, or combinations thereof. Non-limiting examples of the shape of the soft magnetic phase nanoparticles may include spherical, aspherical, elongated, cube, hexagonal, or combinations thereof.

As used herein, the term "nanoparticles" may refer to particles having a smallest dimension (such as a diameter or thickness) in a range from about 1 nanometer to about 1000 nanometers. In certain embodiments, the thickness of the nanoparticles of the hard magnetic phase may be in a range from about 1 nanometer to about 500 nanometers. In some embodiments, an aspect ratio of the nanoparticles of the hard magnetic phase may be greater than 1:1; in certain embodiments the aspect ratio is greater than 2:1 and in particular embodiments the aspect ratio may range up to about 100:1, for instance in a range from about 2:1 to about 100:1. In embodiments where the morphology of the nanoparticles of the hard magnetic phase is anisotropic, the hard magnetic phase may comprise nanoflakes, nanorods, or any other anisotropic geometrical or non-geometrical shape. An interparticle spacing between nanoparticles of the hard magnetic phase may be in a range from about 1 nanometer to about 50 nanometers. In one embodiment, the nanoparticles of the soft magnetic phase may have a size in a range from about 1 nanometer to about 50 nanometers.

As will be appreciated, a composite energy product of a nanocomposite permanent magnet is a function of coercivity ($H_{ci}$) and composite remanence ($M_r$) of the magnet, and hysteresis loop squareness. The composite remanence ($M_r$) may be caused due to a saturation magnetization of the soft magnetic phase. Accordingly, by increasing an intrinsic coercivity ($H_{ci}$) of the hard magnetic phase and enhancing the composite remanence ($M_r$), the composite energy product of the nanocomposite permanent magnets may be increased. In one embodiment, the composite remanence ($M_r$) may be enhanced to a level of saturation magnetization of the hard magnetic phase. To achieve higher remanence values and hysteresis loop squareness for the nanoparticles of the hard magnetic phase, the nanoparticles of the hard magnetic phase may be magnetically aligned. As used herein, the term "magnetically aligned" refers to alignment of the easy axes of magnetization of the nanoparticles of the hard magnetic phase with each other. Hence, the magnetic alignment may also result in crystallographic alignment at least in part of the nanoparticles. In one embodiment, an easy axis for magnetization of the nanoparticles may be aligned within 10 degrees of the magnetization direction.

As will be described in detail below, the alignment of the easy axis for magnetization is facilitated by the application of shear deformation during the fabrication process of the nanocomposite permanent magnet. As used herein, the term "easy axis" refers to an energetically favorable direction of spontaneous magnetization that may be determined by the magnetic anisotropy. In some embodiments, certain crystallographic directions may be referred to as the easy axis for the magnetization. In one embodiment, where the hard magnetic phase comprises samarium cobalt and/or neodymium iron boron, the crystallographic c-direction of the hard magnetic phase may be the easy axis for magnetization. In this embodiment, the c-direction may be perpendicular to a thickness of the flake.

In one embodiment, the methods may enable forming high performance nanocomposite permanent magnets that have relatively low volumes of the hard magnetic phase. The reduction in the volume of the hard magnetic phase proportionally reduces the overall rare earth content in the nanocomposite permanent magnets and provides economical yet high performance permanent magnets.

In one embodiment, the hard and soft magnetic phases may be magnetically coupled by dipolar coupling of the hard magnetic nanoparticles through the soft inter-particle phase. In the absence of a sufficient amount of dipolar coupling, the soft and hard phases may switch independently and the energy product enhancement may not be attained.

In certain embodiments, the nanocomposite permanent magnets may have an energy product of at least about 80 Megagauss-Oersteds as compared to the existing commercial permanent magnets that typically have energy products that range from 10 to about 60 Megagauss-Oersteds. The nanocomposite permanent magnets having higher energy products may enable electric machine designs with high power density, reducing the size and weight of power generation systems. Additionally, the nanocomposite permanent magnets may use up to about 80% less rare earth content than conventional magnets.

FIG. 1 illustrates a sectional view showing the general construction of a permanent magnet electric motor 10. The electric motor 10 may include a plurality of poles 12 disposed within the rotor 14. A shaft 16 may be generally centrally disposed within the rotor 14. In one example, the shaft 16 may be a cylindrical shaft. A volume 18 defined by the plurality of poles 12 may comprise a nanocomposite permanent magnet 20. In one embodiment, the electric motor 10 may comprise a stator 22. The stator 22 may include a plurality of segmented structures, generally represented by reference numeral 24, a plurality of stator slots 26, a plurality of fractional slot concentrated electrical windings 28. In the illustrated embodiment, each of the electrical windings 28 may be individually wound around a tooth belonging to a plurality of stator teeth 30.

In certain embodiments, when examined with a technique with suitably high resolution, such as but not limited to, transmission electron microscopy, the nanocomposite permanent magnet disclosed herein may exhibit at least two distinct phases, i.e. the soft magnetic phase and the hard magnetic phase. The phases may be separated from one another by a spacing of 1 to 50 nanometers.

Figure 2:
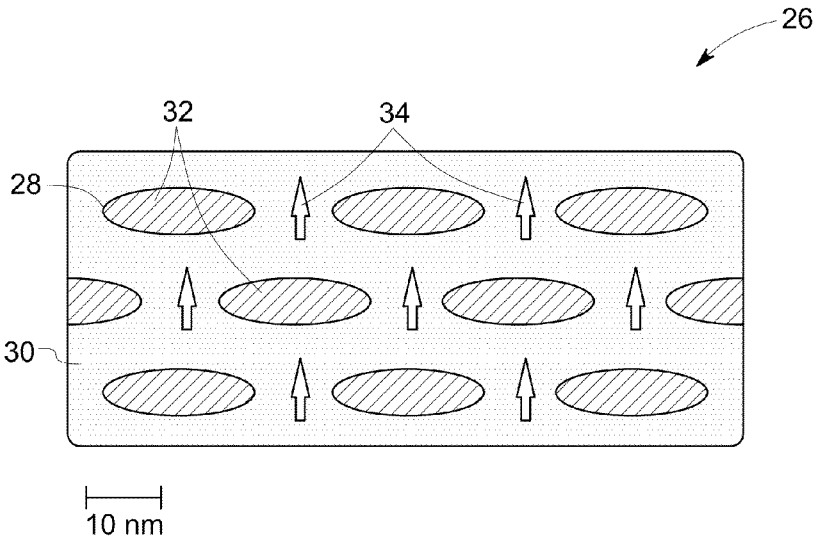
FIG. 2 is a schematic representation of an example nanocomposite permanent magnet having a matrix based structure, where a hard magnetic phase is dispersed in a matrix of a soft magnetic phase, in accordance with embodiments of the present technique.

FIG. 2 illustrates a micrograph of an example nanocomposite permanent magnet 26. The magnet 26 comprises a hard magnetic phase 28 dispersed in a matrix of a soft magnetic phase 30. In the illustrated embodiment, the hard magnetic phase 28 comprises anisotropic nanoparticles 32.

A thickness of grains of the hard magnetic phase may be in a range from about 10 nanometers to about 200 nanometers. The thickness is the smallest dimension of the grain. Further, an aspect ratio of the grains of the hard magnetic phase may be up to about 100:1. An inter-particle spacing between the grains of the hard magnetic phase may be in a range from about 1 nanometer to about 50 nanometers. The magnetically easy crystallographic axes 34 of the anisotropic nanoparticles 32 may be aligned with each other to facilitate higher remanence values, hysteresis loop squareness, and energy product. Those skilled in the art will appreciate that aligning of the magnetically easy crystallographic axes 34 refers to aligning of magnetically easy crystallographic axes of the individual particles within ±10 degrees of each other. In one example, the crystallographic easy axes of the nanoparticles 32 may be aligned within 10 degrees.

In a non-limiting example, the hard magnetic phase 28 may be made of samarium cobalt and the soft magnetic phase 26 may be made of iron. In one embodiment, the magnet 26 may be an anisotropic composite of samarium cobalt and iron with uniform dispersion of the samarium cobalt nanoflakes in the matrix of the iron nanoparticles.

Figure 3:
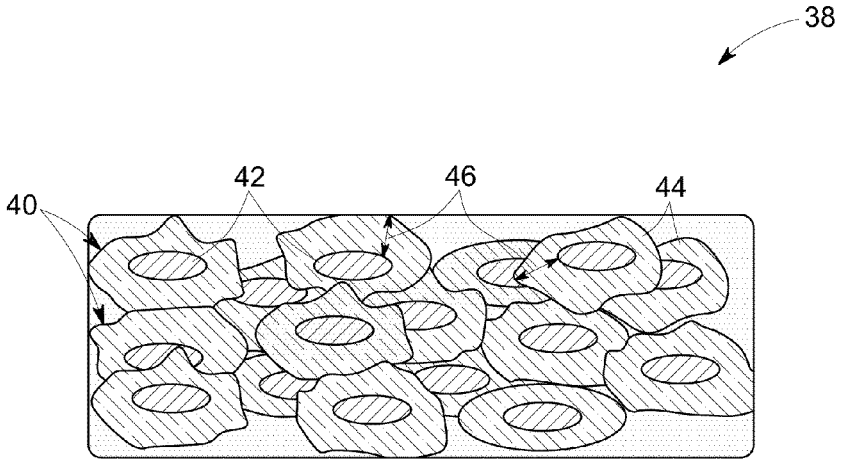
FIG. 3 is a schematic representation of an example nanocomposite permanent magnet having a core-shell based structure, where a hard magnetic phase forms a core and a soft magnetic phase forms a shell, in accordance with embodiments of the present technique.

FIG. 3 illustrates an example nanocomposite permanent magnet 38 having a core shell structure 40. In the illustrated embodiment, the magnet 38 comprises the core shell structures 40, where nanoparticles of a hard magnetic phase forms cores 42 and nanoparticles of a soft magnetic phase forms shells 44 around the core 42. The cores 42 and shells 44 may comprise monocrystalline or polycrystalline material. In one embodiment, the core may be crystalline and the shells 44 may be amorphous in nature. The shells 44 may be in the form of a coating, a single layer, a multilayer stack, or combinations thereof. The cores 42 may be coated with the shells 44. A size of the core 42 may be in a range from about 10 nanometers to about 200 nanometers. A thickness 46 of the shell 44 disposed around the core 42 may be in a range from about 1 to about 25 nanometers An inter-particle spacing between neighboring cores 42 of the hard magnetic phase may be in a range from about 1 nanometers to about 50 nanometers. Furthermore, to achieve desirable values of magnetic remanence, the magnetically easy crystallographic axes of the cores 42 may be aligned within 10 degrees of each other.

The core-shell structure 40 may facilitate exchange bias (a shift of the hysteresis loop along the field axis), and thermal stability of the core 42. A close contact between the core 42 and the shell 44 may facilitate effective exchange coupling and therefore cooperative magnetic switching between the hard and soft magnetic phases. The cooperative magnetic switching between the hard and soft magnetic phases may facilitate the fabrication of nanostructured magnetic materials with enhanced properties. The formation of a nanocomposite structure may facilitate the exchange coupling between the hard phase through the soft phase, and reduce the ability of the soft phase to switch before the hard phase thereby retaining a substantial fraction of the coercivity of the hard phase. The core-shell structure 36 may also improve the compressibility of the permanent magnet 38 by controlling the shell thickness and composition. Further, the core-shell structure 36 may demonstrate a relatively higher ductility as compared to single phase materials. The increased ductility may facilitate the compaction of the core-shell structure 36.

In certain embodiments, the methods of making the nanocomposite permanent magnet may facilitate making the nanocomposite permanent magnets in bulk quantities while retaining the properties of the individual constituents of the magnets. Therefore, the methods are suitable for small-scale as well as industrial applications that require large-volume synthesis. The methods may produce nanocomposite permanent magnets at a scale of hundreds to thousands of kilograms.

The method for making the nanocomposite permanent magnets may commence with the production of nanoparticles of the hard and soft magnetic phases and the nanoparticles are aligned and consolidated into bulk nanocomposite permanent magnets. The constituent phases may be produced by chemical and/or mechanical means. In certain embodiments, the phases are produced as separate nanoparticles and blended together. In these embodiments, the nanoparticles of the hard magnetic phase may be dispersed in the matrix formed by the soft magnetic phase. In certain other embodiments, the nanoparticles of the hard and soft magnetic phases may form a core shell structure. In these embodiments, the nanoparticles of the hard magnetic phase may form the core, and the nanoparticles of the soft magnetic phase may form the shell. The core may be produced by mechanical milling and the soft magnetic shell may be introduced by chemical coating of the permanent magnet core. In some embodiment, a third phase may be introduced in the core-shell nanoparticles. In some of these embodiments, the third phase may include a non-magnetic phase.

Steps are taken during the process sequence to avoid contamination with oxygen and carbon, which is of particular concern to highly reactive rare-earth based nanoparticles.

In certain embodiments, extreme shear deformation may be applied to consolidate the hard and soft magnetic phases. It has been unexpectedly discovered that in some cases extreme shear deformation described herein produces nanocomposite permanent magnets that exhibit energy products of at least about 80 Megagauss-Oersteds. This is a substantial improvement over the best conventional magnets which have an energy product of approximately 60 Megagauss-Oersteds.

Figure 4:
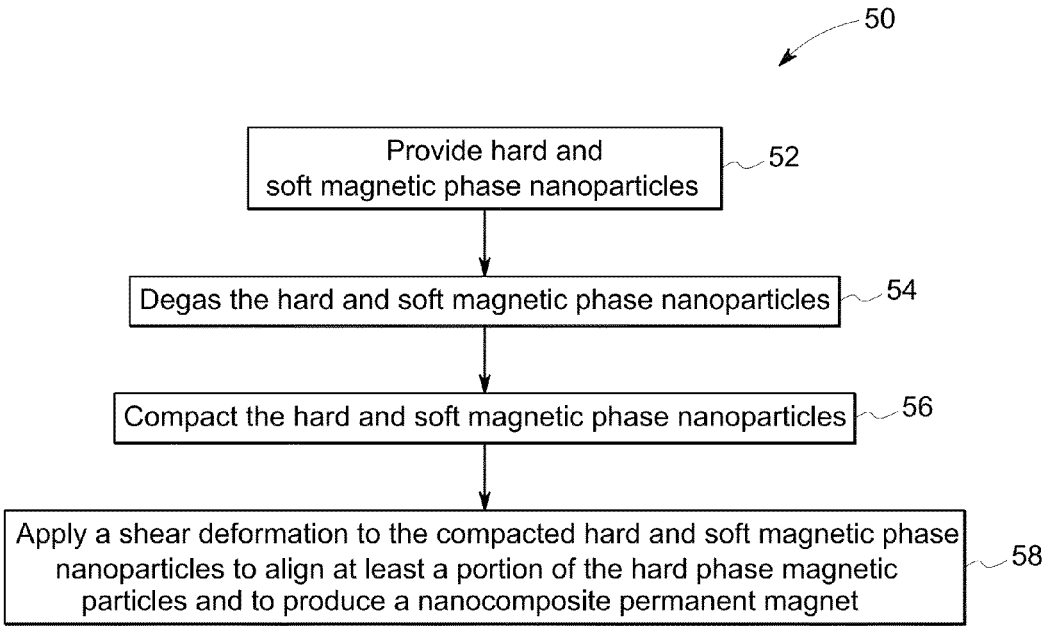
FIGS. 4-5 are flow charts for methods of making nanocomposite permanent magnets, in accordance with embodiments of the present technique.

FIG. 4 illustrates a flow chart 50 for a method of making a nanocomposite permanent magnet. At step 52, hard and soft magnetic phase nanoparticles may be provided. In one embodiment, the hard and soft magnetic phases may be provided as a blend. In another embodiment, the hard and soft magnetic phases may be provided as a core-shell structure.

In certain embodiments, the nanoparticles of the hard magnetic phase may have elongated morphologies, such as flakes, rods, etc. The particles of the hard and soft magnetic phases may be nanoparticles. That is, a smallest dimension of the particles may be in a range from about few nanometers to about few hundreds of nanometers. The coarser particles may be anisotropic. In one embodiment, the particles of the hard magnetic phase may be coated with one or more surfactants. In one example, the surfactant coated particles may be formed by using precursors having coarser particles of the hard magnetic phase material. The precursor particles of the hard magnetic phase material may be disposed in a surfactant and a solvent. In some embodiments, the precursor particles of the hard magnetic phase may be subjected to ball-milling to obtain surfactant coated nanoparticles. In one embodiment, the aspect ratio of the nanoparticles may be altered by varying processing parameters, such as but not limited to, ball to material ratio, milling speed, milling time, and types and amounts of solvent and surfactant. It is desirable to control the milling conditions to enable enhanced magnetic properties of the permanent magnet nanoparticles. For example, unsuitable milling conditions may damage the nanostructure of the permanent magnet nanoparticles, lowering both their remanence and coercivity. Further, poor environment control may lead to excessive oxidation of the permanent magnet nanoparticles, particularly as the particle size decreases. In one embodiment, the nanoparticles of the soft magnetic phase may be less than about 500 nanometers.

In embodiments where the particles of the hard and soft magnetic phases are provided as a blend, a surfactant and a solvent may be mixed with the blend of the particles, and the particles may be processed. In one embodiment, the processing may include milling. The process of milling may facilitate production of homogenous blend by disintegrating agglomerates of the magnetic phases and mixing the two phases.

At step 54, the hard and soft magnetic phases may be subjected to degassing. The step of degassing may be performed in a vacuum environment, an environment with reduced pressure, or in the presence of an inert gas. In one embodiment, the step of degassing may be performed at a temperature in a range from about room temperature to about 300° C. Degassing may aid in removal of at least a portion of a surfactant, and/or undesirable gases such as oxygen. Compaction of the hard and soft magnetic phases prior to consolidation aids in providing a nanocomposite with higher density.

At step 56, the degassed hard and soft magnetic phases may be compacted to form a solidified mass having both the hard and soft magnetic phases. Optionally, the hard and soft magnetic phases of the nanoparticles may be subjected to a magnetic field to magnetically align the nanoparticles prior to the compaction of the hard and soft magnetic phases.

At step 58, the compact may be subjected to shear deformation to align at least a portion of the hard phase magnetic particles with each other and to produce a nanocomposite permanent magnet. In one embodiment, the amount of shear deformation may be in a range from about 100% to about 500%. The shear deformation may be applied in a single pass or a plurality of passes of the compact through the device used to apply the shear deformation.

In one embodiment, extreme shear deformation may be applied to achieve a dense magnet with minimal porosity. In certain embodiments, the extreme shear deformation includes techniques that impart strains greater than 100% under high hydrostatic pressure, without significant changes in the overall dimensions of the specimen. In one example, an equivalent strain of an high pressure torsion (HPT) processed 10 mm disk is around 6 at the outer radius after just 2 turns, while the applied pressure is 5 GPa. The stress state imparted to the nanoparticles during extreme shear deformation enables densification and alignment of the hard magnetic nanoparticles with aspect ratios greater than one. In one embodiment, alignment may be enabled during extreme shear deformation when the hard nanoparticles rotate and become oriented parallel to the principal shear direction.

Advantageously, the extreme shear deformations may apply very large strains that are imposed without introducing significant changes in the overall dimensions of the compact. As will be described in detail with respect to FIGS. 9, 10 and 12, a further advantage of the shear deformation techniques is that the preservation of shape is achieved due to special tool geometries which minimize or eliminate the free flow of material and thereby produce a significant hydrostatic pressure. The presence of a high hydrostatic pressure, in combination with large shear strains, is useful for producing high densities of crystal lattice defects, particularly dislocations, which may result in a significant refining of the grains or nanoparticles. The presence of a high hydrostatic pressure, in combination with large shear strains at room and relatively low temperatures, is useful for producing high densities of crystal lattice defects.

Further, as the dimensions of the compact practically may not change during the extreme shear deformation operation, the process may be applied repeatedly to impose exceptionally high strains. Optimization of routes and regimes of the extreme shear deformation may eventually introduce an extremely fine microstructure into the processed material which will extend, reasonably homogeneously, throughout the bulk.

Figure 5:
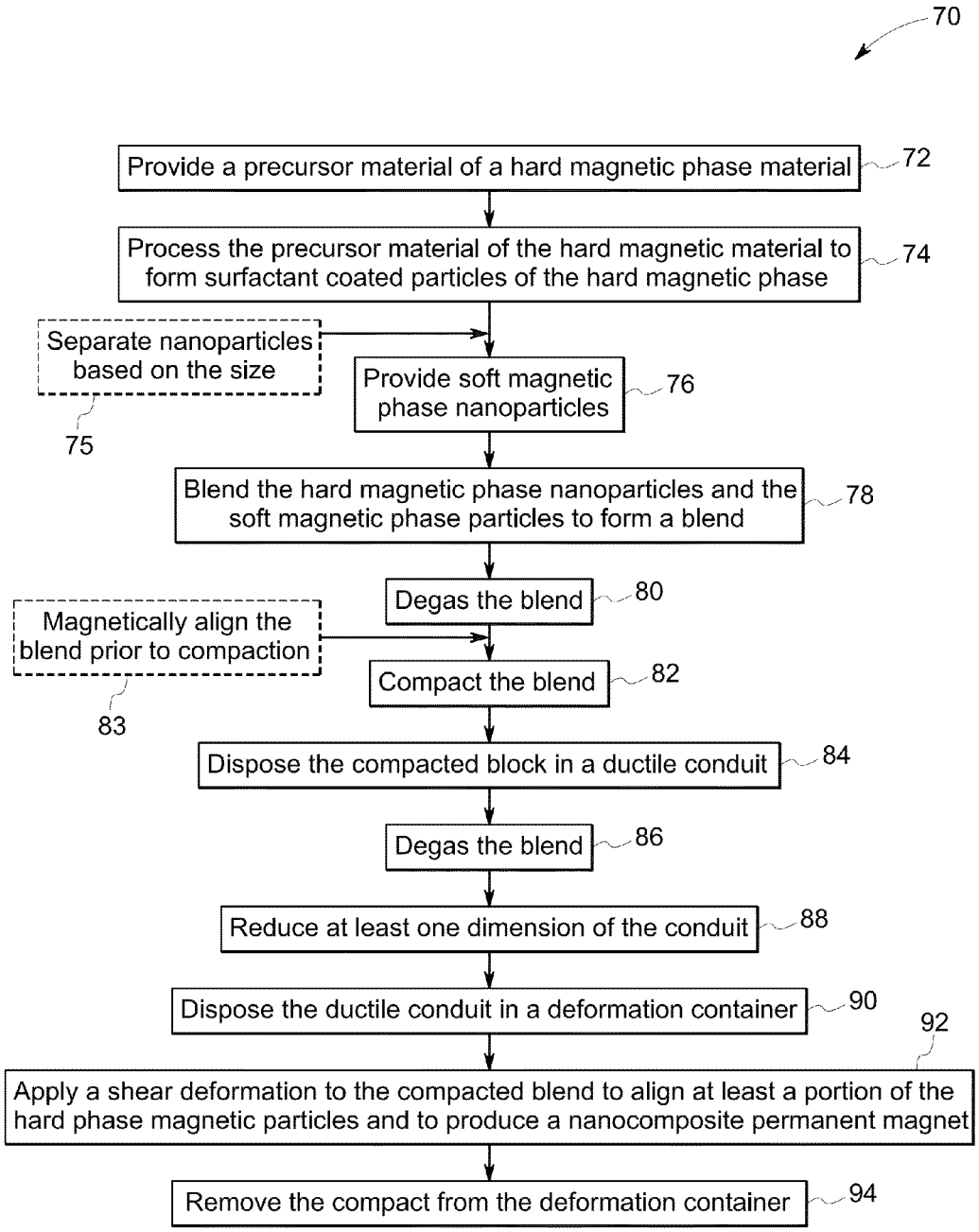

FIG. 5 illustrates a detailed flow chart 70 of a method of making a nanocomposite permanent magnet. At step 72, the method comprises providing a precursor material for a hard magnetic phase material. The precursor material may comprise particles of a hard magnetic phase material. In one embodiment, the particles of the hard magnetic phase may be in a range from few microns to about few nanometers. In one embodiment, anisotropic precursor materials may be provided.

In certain embodiments, the precursor material may be in the form of a powder of the chemical compound of the hard magnetic phase. Non-limiting examples of such powders may comprise samarium cobalt (e.g., $SmCo_5$, $Sm_2Co_{17}$), neodymium iron boron ($Nd_2Fe_{14}B$), samarium iron nitrogen (e.g., $Sm_2Fe_{17}N_3$), iron platinum, cobalt platinum, iron palladium, cobalt palladium, aluminum nickel cobalt, barium-hexaferrite, strontium-hexaferrite, manganese bismuth, manganese aluminum, or combinations thereof. In one embodiment, the magnetic nanoparticles may be synthesized by surfactant-assisted ball milling. High energy surfactant-assisted ball milling may be used to reduce agglomeration. The starting powders may have particle in a range from about 1 micron to about 100 microns.

At step 74, the precursor material for the hard phase magnetic material may be processed. A first solvent may be added to the precursor material. In one example, the solvent may be an organic solvent. In one example, the solvent may be ethanol or heptane.

In one example, an amount of the first solvent may be in a range from about 55% by weight to about 300% by weight of the weight of the precursor material. In one embodiment, a solvent that requires lesser temperature may be desirable, so that the solvent may be easily removed during subsequent steps such as consolidation.

Further, a first surfactant may be added to the mixture of the precursor material and solvent. In one embodiment, it may be desirable to use surfactants that do not contain oxygen. For example, during processing of the precursor material the oxygen-containing surfactants may result in undesirable oxidation of the resultant nanoparticles. Non-limiting examples of the first surfactant may include fatty acids or fatty amines having medium to long carbon chains. Examples would include oleic acid and oleyl amine, decylamine, erucic acid, caprylic acid, fish oil, stearyl amine, tallow amine, linoleic acid, and other long chain amine surfactants. In one example, the surfactant may include a long hydrocarbon chain for each head group. In another example, the amine may have two hydrocarbon chains such as in dioctylamine or didodecylamine. In one embodiment, an amount of surfactant used may be in a range from about 5% by weight to about 50% by weight of the total weight of the precursor material.

The resultant mixture may be subjected to powder processing to produce surfactant coated nanoparticles of the hard magnetic phase. In a non-limiting example, the powder synthesis may include milling of the precursor material in the presence of the solvent and the surfactant. The milling may facilitate uniform mixing and de-agglomeration of the precursor material.

It is desirable to have a particle size of the hard phase magnetic material relatively small. Smaller size of the particles of the hard phase magnetic material facilitates effective exchange coupling with the soft phase in the nanocomposite. However, the small size of the particles of the hard phase magnetic material may result in lower magnetization and lower maximum energy product ($(BH)_{max}$) Therefore, the milling energy and time may be accordingly controlled to form a desirable balance between the particle size and magnetization values.

In one embodiment, the milling may include ball milling. In one example, the milling may be performed in a vibrating environment. In one embodiment, one or more rolling vials containing balls may be used for milling. The balls for the milling may include stainless steel, hardened steel, carbide or other ceramic balls. Duration of milling may vary depending on the amount, type, and morphology of starting materials. In one embodiment, the milling durations may be in a range from about 1 hour to about 50 hours. The milling time, number of balls, vibrating frequency, rolling speed of the vials may be adjusted to form the desired nanocomposite morphology. The ball to powder weight ratio may include 10:1 to about 2:1, alternatively 6:0.5 to about 7:3, or 5:1.

In one example, the milling may include a high-energy mechanical milling. Higher milling energy may include higher ratio of ball with respect to powder, or higher frequency in milling, or longer milling time. Higher milling energy may result in finer particles that have high coercivity ($H_{ci}$), but lower magnetization.

In one embodiment, the milling process and handling of the powders of the precursor material as well as the milled particles may be carried out in an oxygen-free inert environment. In one example, nitrogen, argon gas or other inert gases may be used to provide an inert environment.

The powder processing may produce anisotropic nanoparticles (such as nanoflakes) of the hard magnetic phase that are coated with the first surfactant. The anisotropic nanoparticles may comprise a crystallographic easy axis for magnetization. The surfactant may act as a protective coating and as a dispersant agent for the nanoparticles.

The processed particles of the hard magnetic phase may be monocrystalline or polycrystalline. Further, particles of the hard magnetic phase may include any shape, such as spherical, elongated, or any other geometrical or non-geometrical shape. The hard phase magnetic particles may comprise up to 50% volume fraction amorphous phase. The amorphous phase may exhibit high magnetization ($4\pi m$) and remanence ($B_r$). In one embodiment, the remanence may be greater than about 8.6 kG.

Optionally, the nanoparticles of the hard magnetic phase may be further processed for recrystallization. In one embodiment, magnetic properties of the processed particles of the hard magnetic phase may be increased by recrystallizing the nanoflakes, such as by thermally treating (annealing) the hard magnetic phase at a temperature, and for a time, suitable to drive recrystallization. In one embodiment, the nanoparticles may be recrystallized via annealing in an inert environment.

In one embodiment, nanoflakes of the hard magnetic phase may have a narrow size distribution of thickness values. The narrow size distribution may be accompanied by high coercivity $H_{ci}$. In one example, the size distribution of the thickness of the nanoflakes may be in a range from about 100 nanometers to about 300 nanometers. In another embodiment, the size distribution of the thickness of the nanoflakes may be in a range from about 10 nanometers to about 20 nanometers.

The aspect ratio of the resultant particles of the hard magnetic phase may be varied by varying one or more of milling parameters including a milling speed, a milling time, and a ratio of milling ball to powder.

As illustrated in FIG. 6, surfactant coated anisotropic nanoparticles of $SmCo_5$ with flaky morphology may be produced. In the illustrated embodiment, the magnetically easy axis of the nanoflakes may be perpendicular to the flake thickness.

Referring back to FIG. 5, optionally, at step 75, nanoparticles with different size ranges may be separated. In one embodiment, centrifugal separation may be used to segregate particles based on the size distribution. The particles with desirable particle size range may be selected for further processing. The particle size range may comprise a size distribution in one of the ranges discussed above.

At step 76, a soft magnetic phase material may be provided. In one embodiment, the soft magnetic phase material may be produced by well-known techniques using compounds or alloys, such as but not limited to, iron, iron cobalt, iron silicon, iron nickel, and iron boron, or combinations thereof. In one embodiment, the soft magnetic phase material may be produced by reduction of corresponding metal iron salts.

In one embodiment, the soft phase magnetic particles may be synthesized from their respective salts. In one example, a salt-matrix annealing technique may be used to synthesize the soft phase magnetic particles such as iron cobalt. The size of the particles of the soft magnetic phase may be in a range from about 5 nanometers to about 50 nanometers.

Figure 7:
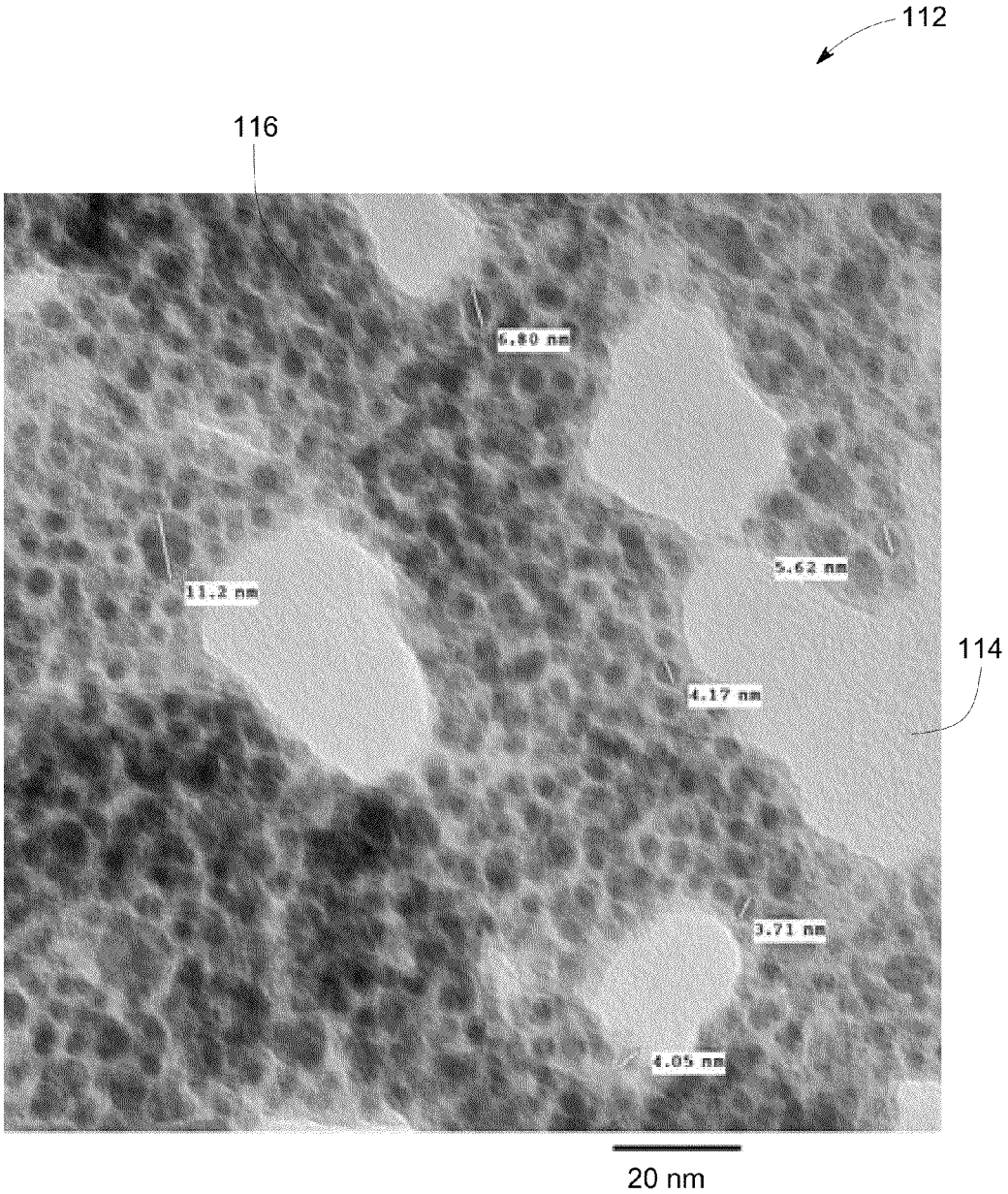
FIG. 7 is a micrograph of example nanoparticles of a soft magnetic phase, in accordance with embodiments of the present technique.

FIG. 7 illustrates a soft magnetic phase 112 having agglomerates 114 and particles 116 of metal iron. A size of the particles 116 may be less than about 50 nanometers. In one embodiment, the soft magnetic phase 112 may comprise mono-disperse particles 116. The monodiperse nanoparticles 116 may be synthesized by chemical reduction of metal precursors under inert atmosphere, in the presence of surfactants. The size of the nanoparticles 116 may be controlled by reaction concentration, amount of surfactant, heating-rate, reaction temperature or combinations thereof. The synthesized nanoparticles 116 may be isolated and purified by precipitation using anti-solvents under inert atmospheres. In one embodiment, an XRD analysis of these nanoparticles indicates pure bcc iron structure.

Figure 8:
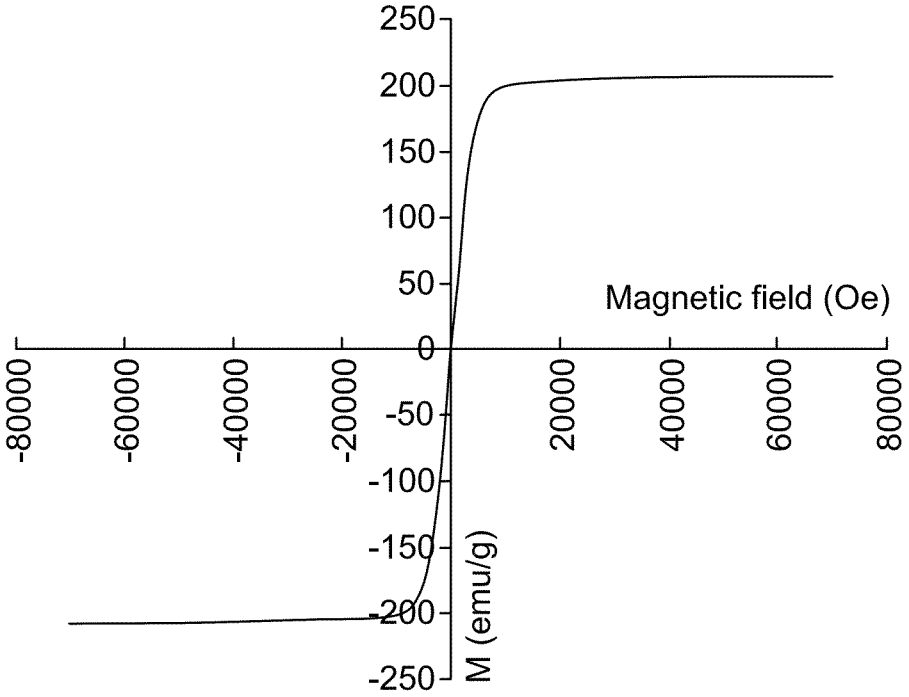
FIG. 8 is a graphical representation of magnetic saturation levels of the nanoparticles of the soft magnetic phase of FIG. 7.

FIG. 8 illustrates saturation levels of iron particles of FIG. 7. In the illustrated embodiment, the saturation levels for the iron particles having a size of less than about 50 nanometers may be about 200 emu/g. The nanoparticles may demonstrate high Msat values that are close to a theoretical maximum value.

Referring back to FIG. 5, at step 78, the hard and soft magnetic phase materials may be blended. The blending may include mixing the surfactant coated nanoparticles of the hard magnetic phase and the particles of the soft magnetic phase. A second solvent and a second surfactant may be added to the blend.

Non-limiting examples of the second solvent may include an organic solvent. In one example, the solvent may be ethanol or heptane. Non-limiting examples of the second surfactant may include fatty acids or fatty amines having medium to long carbon chains, oleic acid and oleyl amine, derivatives of oleic acid, erucic acid, caprylic acid, fish oil, oleylamine, linoleic acid, and the other long chain carboxylic acids surfactants. In one example, the surfactant may include a long hydrocarbon chain for each head group. In one embodiment, an amount of surfactant used may be in a range from about 5% by weight to about 20% by weight of the total weight of the precursor material.

The first and second solvents may be the same or different. Similarly, the first and second surfactants may be the same or different. In one example, the second solvent may be heptane, and the second surfactant may be oleylamine.

During processing of the hard phase magnetic particles, or the blend, the surfactants may be absorbed by a surface of a particle and may result in a surface modification of the processed particles. The blended or milled powders may be washed with a solvent, such as heptane, to at least partially remove the surfactant.

In certain embodiments, a volume fraction of the soft magnetic phase in the nanocomposite may be in a range from about 5% to 95%. In one example embodiment, the volume fraction of the soft magnetic phase may be in a range from about 5% to 30%. In another example embodiment, the volume fraction of the soft magnetic phase may be in a range from about 50% to 80%. In one example, the nanocomposite permanent magnet may be formed by mixing 20% by volume of the hard magnetic phase, and 80% by volume of the soft magnetic phase. In one embodiment, the hard magnetic phase may comprise samarium cobalt ($SmCo_5$) and the soft magnetic phase may comprise nanoparticles of iron. In this embodiment, 20% of $SmCo_5$ nanoflakes (in volume) may be mixed in a milling jar with 80% of nanoparticles of iron. In this example, oleylamine may be added to the mixture as a surfactant to promote the de-agglomeration of the agglomerates during milling Heptane, for example, may be used as a solvent. The solvent may be added prior to milling the blend of the hard and soft phase nanoparticles. The solvent may be used as a slurry medium. The solvent may be used to protect the particles from oxidation. All mixing steps may be performed in an inert environment. Further, the milling process may use steel balls to the mixture to break down the agglomerates.

At step 80, the blended powders may be degassed to at least partly remove surfactant from the blended powders. The degasification may be carried out in vacuum at a temperature of less than about 300° C. Degassing may remove at least a portion of the solvents and the surfactants while avoiding coarsening and decomposition of the constituent hard and soft magnetic phases. In one example, a vacuum mechanical pump may be used to degas the blended powders.

At step 82, the degassed mixture may be compacted by transferring the blended and degassed particles into a flexible container. The flexible container may be sealed by e.g., isostatically pressing the container. In one example, the isostatic pressing may comprise cold isostatic pressing. In one example, a rubber or plastic tube may be used as the flexible container. In this example, the tube may be sealed and protected with an outer layer. In one example, the outer layer may be formed by a rubber balloon. The sealed and protected tube may be compacted using cold isostatic pressing (CIP) under a pressure of 60 ksi.

Compacting the blend may facilitate forming nanocomposite permanent magnets with higher density values. In one embodiment, the compacted material may have a density in a range from about 50% to about 70% of a theoretical density. In another embodiment, the compacted material may have a density in a range from about 60% to about 65%.

Optionally, at step 83, the powders may be magnetically aligned prior to compacting. In one example, the powders may be magnetically aligned by disposing the powders in a magnetized environment. The magnetic field in the magnetized environment, for example, may be in a range from about 1 T to about 3 T. In one example, the powders may be disposed in a magnetized environment having a magnetic field of about 1.4 T. In one embodiment, the blend may be exposed to a magnetic field to magnetically orient the nanoparticles of the hard magnetic phase.

At step 84, the compact may be disposed in a ductile conduit such as a copper tube for further processing.

At step 86, another degassing step may be performed to remove any residual solvent, surfactant, or adsorbed gasses such as argon from the compact. In one embodiment, solvents and surfactants may be at least partially removed from the constituent by vacuum degassing at a temperature below 300° C. prior to consolidation.

After degassing, the end of the ductile conduit may be sealed to isolate the compacted powder from environmental gases, such as oxygen.

At step 88, the ductile conduit may be compressed to reduce at least one dimension of the conduit. The ductile conduit may be compressed to desirable dimensions of the final product, i.e., the nanocomposite permanent magnet. In one embodiment, the ductile conduit may be swaged or cold isostatically pressed to reduce the at least one dimension of the conduit.

At step 90, the sealed ductile conduit may be disposed in a deformation container for consolidation. The outer dimensions of the deformation container may be similar to a size of a die used in the shear deformation process. The deformation container may transmit the shear strain during the shear deformation to the compact.

At step 92, the compact is consolidated using shear deformation processes. In one embodiment, consolidation may include aligning the magnetic orientation of the nanoparticles of the compact by crystallographically aligning the nanoparticles using the shear deformation. Crystallographic alignment facilitates anisotropic properties as magnetization changes with direction of the crystallographic orientation. In some embodiments, an anisotropic nanocomposite magnet is formed by consolidation via extreme shear deformation. In one embodiment, the process of consolidation may also include alignment of the hard phase magnetic material. In these embodiments, an anisotropic composite is formed by crystallographic alignment of the nanoparticles and subsequent consolidation via extreme shear deformation.

The shear deformation processes may yield enhanced crystallographic alignment of the hard magnetic phase nanoparticles. In one embodiment, shear deformation may provide localized shear straining in portions of the nanocomposite compact. The localized straining may facilitate crystallographic alignment of the nanoparticles of the hard magnetic phase.

In one embodiment, an equal channel angular extrusion (ECAE) process may be employed to produce a consolidated nanocomposite permanent magnet having magnetically and crystallographically aligned hard magnetic phase. In another embodiment, a high pressure torsion (HPT) method may be applied to produce a consolidated nanocomposite permanent magnet having magnetically and crystallographically aligned hard magnetic phase. The stress state imparted during extreme shear deformation enables densification and alignment of the hard magnetic nanoparticles having aspect ratios greater than one. Further, alignment is enabled during extreme shear deformation when the hard nanoparticles rotate and become oriented parallel to the principal shear direction.

In certain embodiments, it may be desirable to provide a tool design for extreme shear deformation process such that the tool design satisfies the various requirements of the extreme shear deformation process. For example, in the case of ECAE, the friction is desired to be reduced between the moving parts of the die. In the case of HPT, high load bearings may be desirable to transmit shear while applying higher loads. In certain embodiments, the initial processing steps, leading to the final consolidation through ECAE and HPT processes may be conducted without exposing the material to oxygen. For example, the process steps such as, but not limited to, pre compaction and degassing may include taking precautions to provide protection from contamination. In one embodiment, it may be desirable to seal the pre-compacts immediately before the consolidation step. In the case of HPT process, the sealing requirement may present an additional challenge because the friction between the sample and the dies is desired to be high to transmit the shear. Accordingly, appropriate sealing technique that may not reduce the friction between the sample and the dies may be adopted. For example, an airtight foil, such as but not limited to, a metal or a plastic foil may be used to encapsulate the hard and soft magnetic phase nanoparticles prior to the application of the HPT process. In the case of ECAE, coordinating between the magnetic pre alignment and shear induced alignment may be an additional challenge. For example, it may be relatively difficult to track the magnetic alignment direction such that the magnetic alignment direction is consistent with the shear directions resulting from different ECAE routes. The alignment requirement is further aggravated due to the brittle nature of the compacts (e.g., pellets) and the limited magnetizer coil diameter, multiplying the number of compacts that need to be aligned with respect to each other.

In one example, the compacted powder may be consolidated when passed through the shear zone at the right angle corner of the die. The shear deformation processes may allow better control on the microstructure of the nanocomposite permanent magnet. The ECAE process may be performed in two different fashions.

In one embodiment, the compact may be disposed in the same direction after each pass, and as a result, a lamellar microstructure similar to that produced by a rolling process is achieved. In this example, the hard magnetic nanoparticles may be aligned in the travel direction.

In another embodiment, the compact may be rotated by a determined amount after each pass. The determined amount may be same or different for each pass. By way of example, the billet may be rotated by about 90 degrees. The rotation may be done in clockwise or anticlockwise direction. The orthogonal rotation between passes may introduce shear in different crystallographic systems which in turn enhances the consolidation.

In yet another embodiment, some passes may comprise retaining the orientation of the compact, while other passes may comprise altering an orientation of the compact.

In certain embodiments, as strain is increased during shear deformation a microstructural structural refinement may be achieved along with the increase in strength and hardness. In one embodiment, a shear strain in a range from about 100% to about 500% may be applied in the extreme shear deformation process. In one embodiment, a strain in a range from about 100% to about 500% may be applied in HPT processes.

Figure 9:
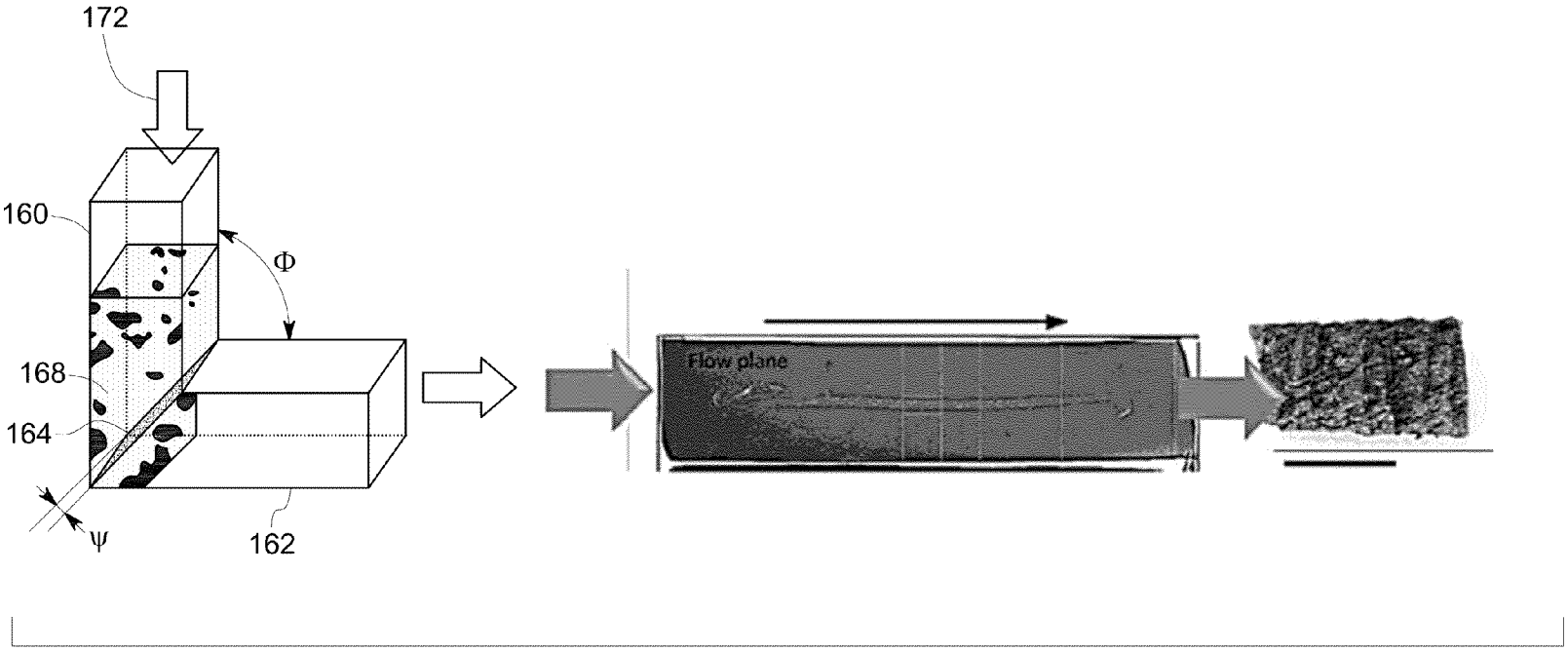
FIG. 9 is a schematic representation of an equal channel angular extrusion (ECAE) process for forming a nanocomposite permanent magnet, in accordance with embodiments of the present technique.

In embodiments where the ECAE process is used to consolidate the nanocomposite compact, the compact may be consolidated without substantial change in the cross section. FIG. 9 illustrates a mechanism of the ECAE process. In the illustrated embodiment, a die system of the ECAE process includes two channels 160 and 162 having identical cross sections connected through the intersection (AA'BB'), represented by reference numeral 164. The intersection 164 of the channels 160 and 162 may have an adjustable angle 166. For extrusion, a compact 168 may be disposed in the first channel 160 before being extruded out in the extrusion direction 70 from the second channel 162 by applying a pressure 172. Equal-channel angular extrusion facilitates extrusion of the compact 168 without substantial change in the geometrical shape of the compact 168. Multiple extrusions from equal-channel angular extrusion allow heavy plastic strain to the bulk material, e.g., the compact 168.

Figure 10:
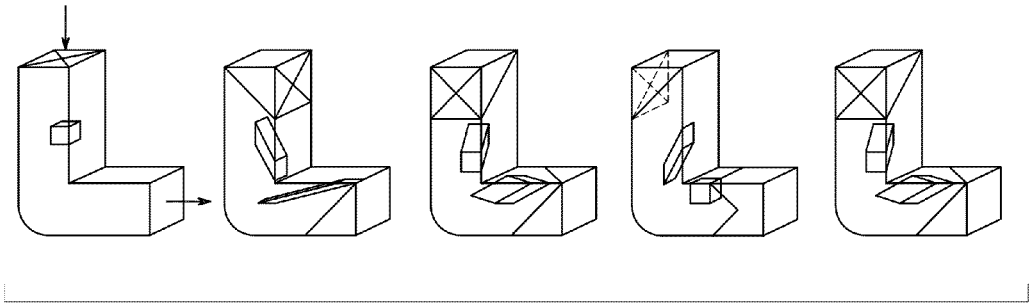
FIG. 10 is a schematic representation of stages of progress in the shear deformation process during the ECAE process of FIG. 9.

FIG. 10 illustrates gradual change in an alignment of a compact from the first channel 160 to the second channel 162, and from one pass to another. This gradual change in alignment facilitates crystallographic orientation during consolidation of the compact.

Figure 11:
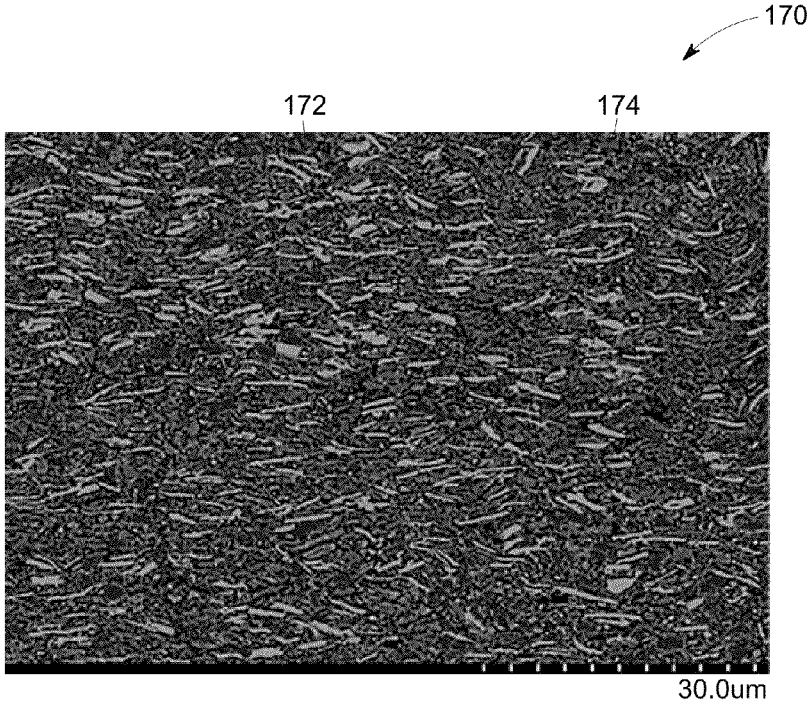
FIG. 11 is a micrograph of a nanocomposite permanent magnet made by using the ECAE process of FIGS. 9 and 10.

FIG. 11 illustrates a micrograph 170 of the nanocomposite permanent magnet formed by the methods of FIGS. 9 and 10.

As illustrated in the micrograph 170, the nanocomposite permanent magnet comprises anisotropic nanoparticles 172 of the hard magnetic phase disposed in the matrix 174 of soft magnetic phase. Also illustrated in the micrograph is that particles 172 with large aspect ratio are better aligned than particles with small aspect ratios.

Turning back to FIG. 5, in one embodiment, by changing the orientation of the billet between successive extrusions, sophisticated and desirable microstructures and textures may be developed in the nanocomposite compact 168.

Since the cross section of the compact or billet remains nearly unchanged after each extrusion, ECAE process is repeatable, and, hence, heavy plastic strain may be obtained by multiple extrusions. By way of example, if the cross sections of the channels are designed as square, the orientation of the shear plane may be easily changed by rotating the billet (±n 90°, n=1 or 2) for subsequent extrusions. This makes it possible to use different routes (A, B, C, and C'), which are defined based on the different combinations of the shear planes, to develop different microstructures and textures within the bulk material.

Figure 12:
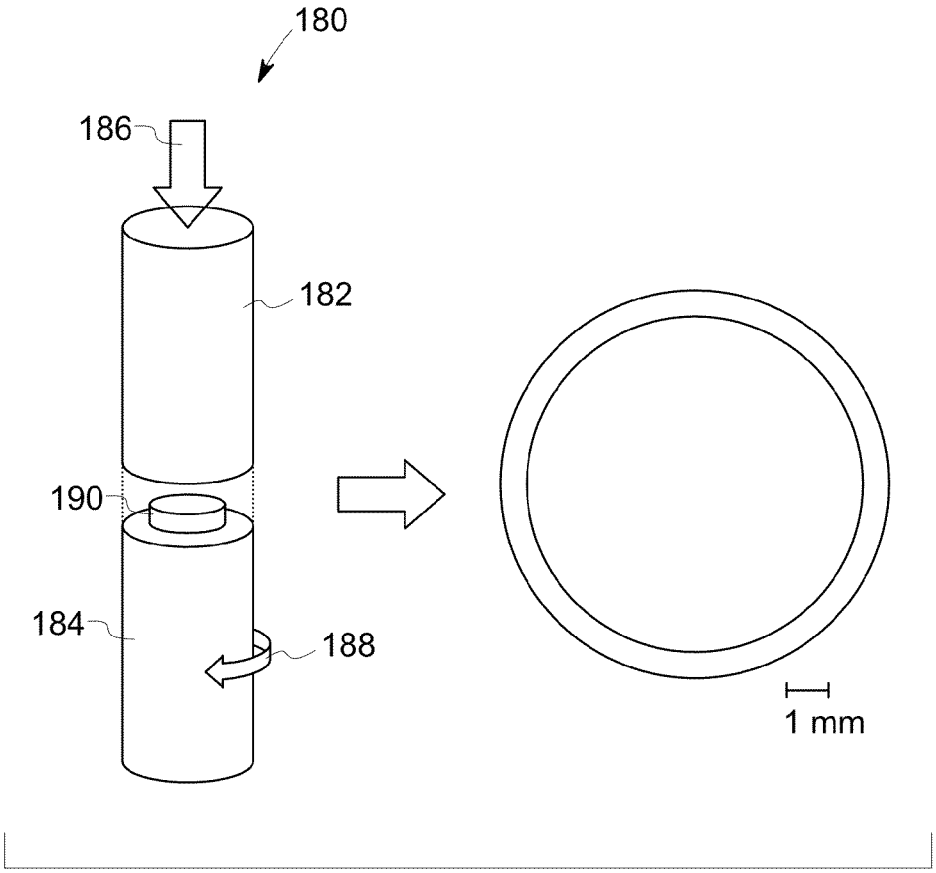
FIG. 12 is a schematic representation of a high pressure torsion (HPT) process for forming a nanocomposite permanent magnet, in accordance with embodiments of the present technique.

In certain embodiments, high pressure torsion (HPT) deformation method may be used for consolidation of the nanocomposite compact. FIG. 12 illustrates an arrangement 180 for HPT. The arrangement 180 may include two dies 182 and 184. The die 182 may be a configured to undergo translational motion, as represented by arrow 186. The die 184 may be configured to rotate about its axis as represented by arrow 188. During the HPT process, the compact 190 experiences pressure applied by the translational motion of the die 182, and a shear strain applied by the die 184. The compact may experience the pressure and shear strain without substantially changing its dimensions.

Turning to FIG. 5, in one embodiment, HPT may be performed at a temperature in a range from about 200° C. to about 500° C. The influence of deformation processing parameters, e.g, resolved shear strain y (number of turns N=1-6) and applied pressure p (constant pressure of 7 GPa), may be evaluated by microstructure analysis and measuring mechanical properties of the deformed compacts.

At step 94, subsequent to consolidation and alignment by extreme shear deformation, the nanocomposite permanent magnet is removed from the deformation container, such as by chemical dissolution of the can material or by machining Optionally, the nanocomposite permanent magnet may be subjected to annealing. The properties of the nanocomposite permanent magnet may be enhanced by annealing. The annealing process allows reordering of any crystallographic disorder induced by mechanical milling, extreme shear deformation, or other process steps.

Figure 13:
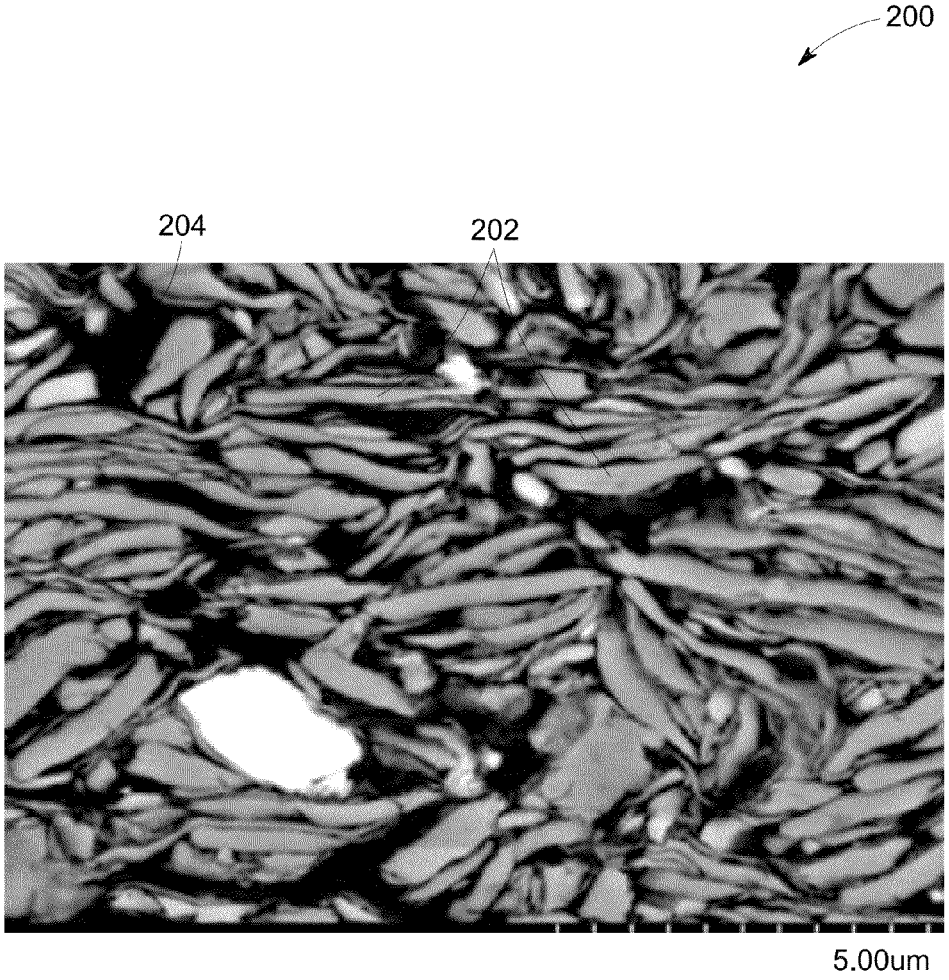
FIG. 13 is a micrograph of the nanocomposite permanent magnet made by using the HPT process of FIG. 12.

FIG. 13 illustrates a micrograph 200 of a nanocomposite permanent magnet formed by the method of FIG. 12. As illustrated in the micrograph 200, the nanocomposite permanent magnet comprises anisotropic nanoparticles 202 of the hard magnetic phase disposed in the matrix 204 of the soft magnetic phase.

Figure 14:
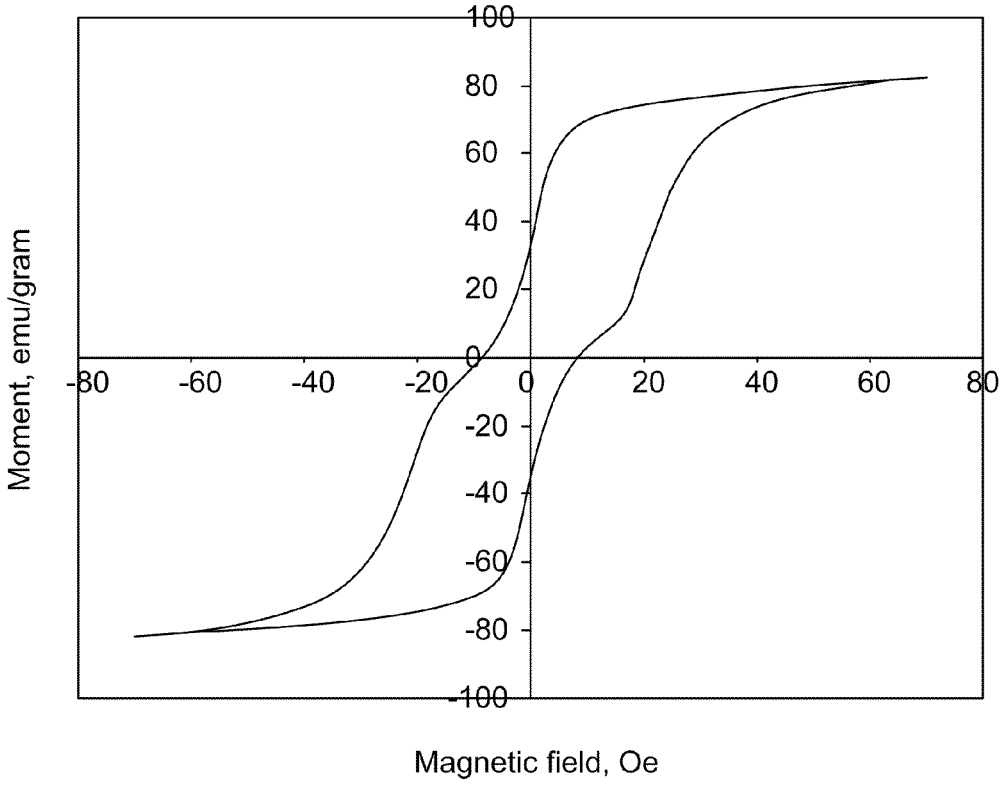
FIG. 14 is a graphical representation of magnetic hysteresis for the nanocomposite permanent magnet of FIG. 13.

FIG. 14 illustrates a graph for magnetic hysteresis of the nanocomposite permanent magnet of FIG. 13. As illustrated, the nanoparticles with higher aspect ratios are relatively better aligned compared to the nanoparticles with relatively lower aspect ratios.

Figure 15:
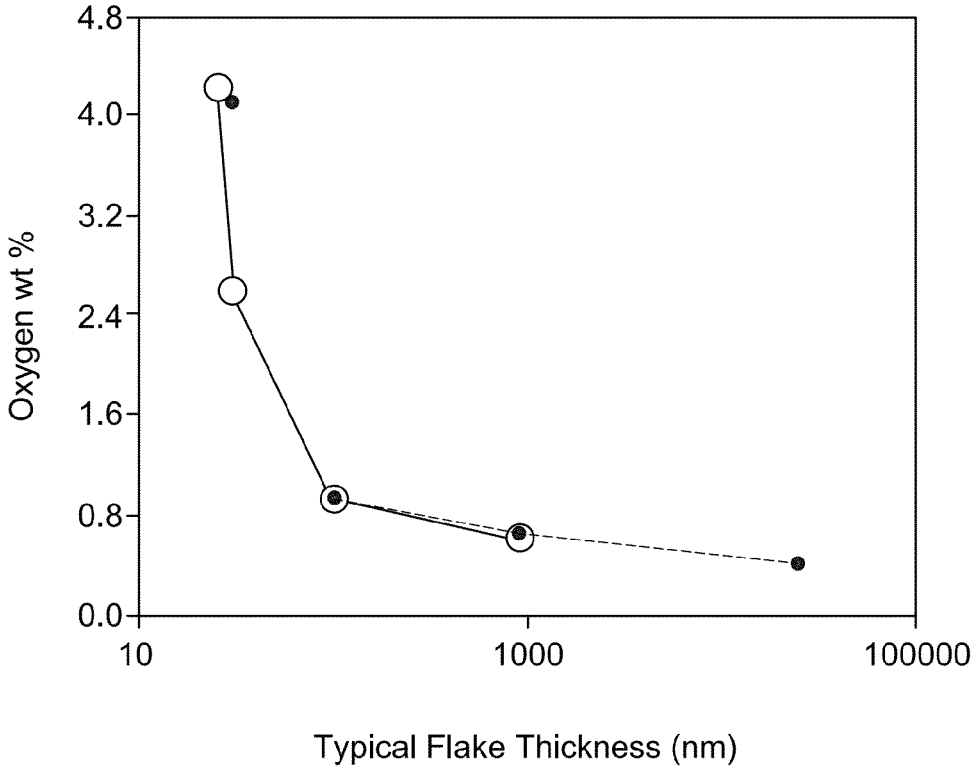
FIG. 15 is a graphical representation of oxygen dependence of a thickness of the hard magnetic phase nanoparticles.

FIG. 15 is a graph illustrating dependence of oxygen content on the thickness of $SmCo_5$ permanent magnet nanoparticles used as starting materials for forming a nanocomposite permanent magnet. Smaller particles have higher surface area to volume ratios resulting in an increased affinity for oxygen contaminants. Oxygen contamination is detrimental to the properties of both the nanoparticle and nanocomposite permanent magnets.

Figure 16:
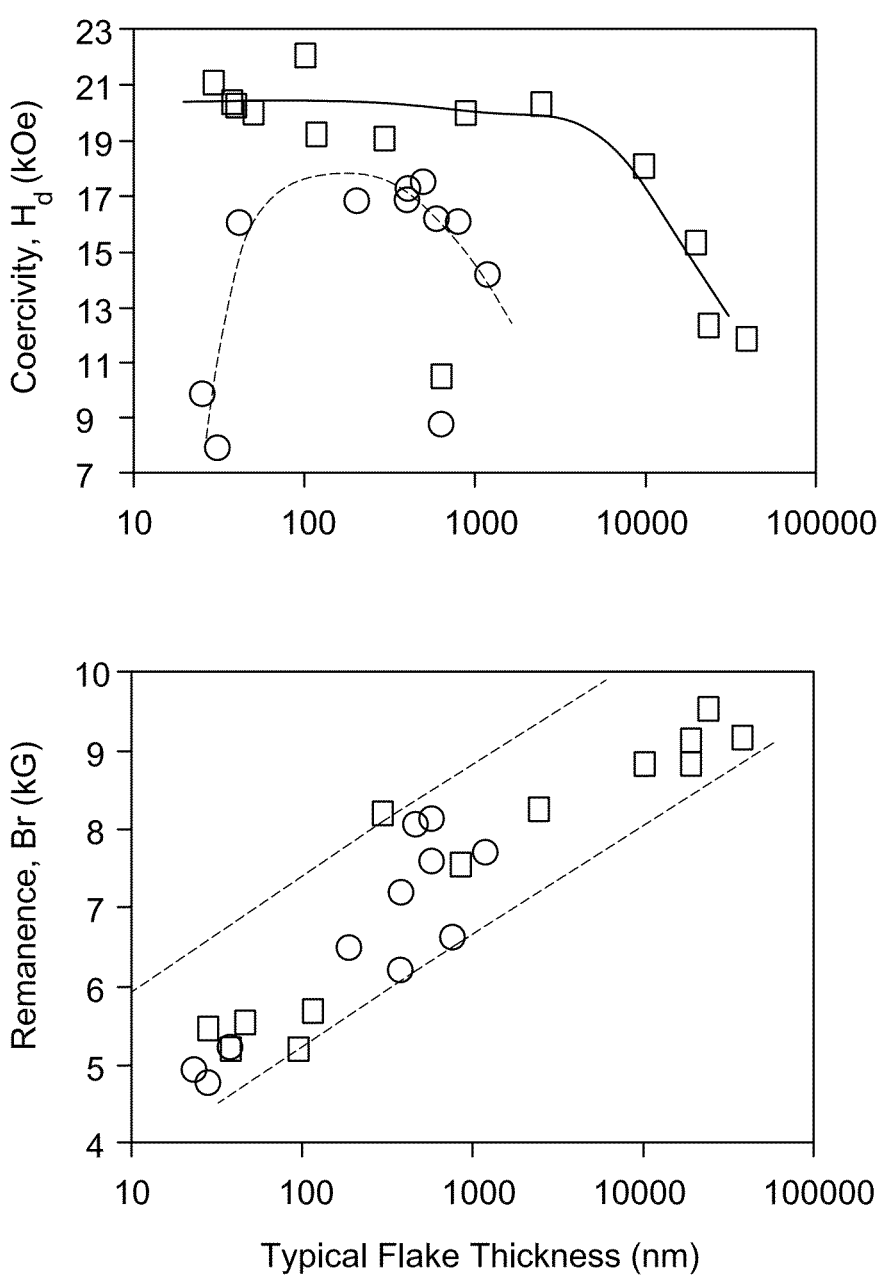
FIG. 16 is a graphical representation of a relationship between particle thickness and remanence and coercivity of a nanocomposite permanent magnet.

FIG. 16 illustrates the dependence of remanence (Br) and coercivity (Hc) on the particle thickness and amorphous content of $SmCo_5$ nanoparticles. In one embodiment, the particle thickness and amorphous content are determined by the milling conditions and particle. In the case of for nanocomposite permanent magnets, it is desirable to have the particle thicknesses of less than about 50 nm. Decreased particle size and increased amorphous content may decrease both the remanence and coercivity, and vice versa. In one embodiment, controlled milling of the nanoparticles may facilitate retaining the coercivity for the smallest particle thicknesses.

One technical advantage of nanocomposite permanent magnets as described herein is the increase in energy product compared to conventional rare-earth permanent magnets. The highest performance nanocomposite magnets may have an energy product of at least 80 Megagauss-Oersteds, which is a substantial improvement over the conventional magnets which typically have an energy product of approximately 60 Megagauss-Oersteds. A commercial advantage of the nanocomposite permanent magnets includes reduced usage of rare earth metals. In certain embodiments, the nanocomposite permanent magnets may contain up to 80% less rare earth content then conventional rare earth magnets. Decreased amount of rare earth metals in the nanocomposite permanent magnets may help reduce or eliminate the supply risk posed by the critical rare earth elements such as Nd, Dy, Tb, and Sm. Further, the decreased amount of the rare earth metals in the nanocomposite permanent magnets may makes the magnets relatively economical by reducing the cost.

High energy product values of the nanocomposite permanent magnets may make it suitable for various applications including, but not limited to, magnetic resonance imaging devices, electric bikes, high-speed motors for oil and gas applications, power generation turbines, such as tidal power generation turbines, hydro power generators, and traction motors for high-speed rail applications. Permanent magnet motors used in various fields may employ the nanocomposite permanent magnets. In one example, the nanocomposite permanent magnets may be used in actuators and generators. Further, the nanocomposite permanent magnets may be used in applications such as, but not limited to, hard disk drives for computers, etc. These applications are expected to grow significantly in the near future, thereby increasing the demand of the nanocomposite permanent magnets.

While only certain features of the invention have been illustrated and described herein, many modifications and changes will occur to those skilled in the art. It is, therefore, to be understood that the appended claims are intended to cover all such modifications and changes as fall within the scope of the invention.

The invention claimed is:

1. A method of making a nanocomposite permanent magnet, comprising:

applying shear deformation to hard magnetic phase nanoparticles and soft magnetic phase nanoparticles to align at least a portion of the hard phase magnetic particles and to produce a nanocomposite permanent magnet further comprising degassing the hard and soft magnetic phase nanoparticles prior to applying the shear deformation to form a degassed composite mixture of the hard magnetic phase nanoparticles and soft magnetic phase nanoparticles;

wherein the step of applying the shear deformation comprises;

disposing the degassed composite mixture in a ductile conduit;

degassing the ductile conduit;

sealing the ductile conduit after degassing;

disposing the ductile conduit in a deformation container; and transmitting a shear strain to the ductile conduit via the deformation container to produce the nanocomposite permanent magnet.

2. The method of claim 1, wherein the hard magnetic phase particles comprise samarium cobalt, neodymium iron boron, samarium iron nitrogen, iron platinum, cobalt platinum, iron palladium, cobalt palladium, aluminum nickel cobalt, barium-hexaferrite, strontium-hexaferrite, manganese bismuth, manganese aluminum,or combinations thereof.

3. The method of claim 1, wherein the soft magnetic phase nanoparticles comprise iron, iron cobalt, iron silicon, iron nickel, and iron boron, or combinations thereof.

4. The method of claim 1, wherein the hard magnetic phase nanoparticles comprise particles having an aspect ratio in a range from about 2:1 to about 100:1.

5. The method of claim 1, wherein the soft magnetic phase nanoparticles are produced by chemically reducing salts of a soft magnetic phase material.

6. The method of claim 1, further comprising pre-compacting the hard magnetic phase nanoparticles and soft magnetic phase nanoparticles prior to applying the shear deformation.

7. The method of claim 1, comprising applying the shear deformation to a core-shell structure of the hard magnetic phase nanoparticles and soft magnetic phase nanoparticles, wherein the hard phase is disposed in the core and the soft phase is disposed in the shell.

8. The method of claim 1, wherein the applying step further comprises applying the shear deformation to a blend of the hard magnetic phase nanoparticles and the soft magnetic phase nanoparticles.

9. The method of claim 8, further comprising:

adding a first solvent and a first surfactant to particles of a hard phase magnetic material to form a mixture;

processing the mixture to form surfactant coated hard magnetic phase nanoparticles.

10. The method of claim 9, wherein the step of processing comprises milling.

11. The method of claim 9, further comprising:

adding a second solvent and a second surfactant to a blend of the surfactant coated hard magnetic phase nanoparticles and the soft magnetic phase nanoparticles;

milling the blend to form a composite mixture having a dispersion of the surfactant coated hard magnetic phase nanoparticles and the soft magnetic phase nanoparticles; and degassing the composite mixture to remove at least portions of first and second solvents and surfactants.

12. The method of claim 1, comprising:

compacting the degassed composite mixture by disposing the degassed composite mixture in a flexible container to form a compacted composite; and cold isostatically pressing the flexible container.

13. The method of claim 1, further comprising magnetically aligning the hard and soft magnetic phase nanoparticles prior to the step of degassing.

14. The method of claim 1, wherein the step of transmitting the shear strain comprises applying one or more passes via equal channel angular extrusion, or via high pressure torsion, or both.

15. The method of claim 14, comprising maintaining the same alignment of the ductile conduit during each pass.

16. The method of claim 1, comprising altering an alignment of the ductile conduit by a determined angle after each pass.

17. The method of claim 1, further comprising disintegrating the deformation container to obtain the nanocomposite permanent magnet.

18. The method of claim 1, further comprising annealing the nanocomposite permanent magnet.

* * * * *